US007073518B2

(12) United States Patent
Ishikawa et al.

(10) Patent No.: US 7,073,518 B2
(45) Date of Patent: Jul. 11, 2006

(54) CLEANING SOLUTION AND CLEANING METHOD FOR MASK USED IN VACUUM VAPOR DEPOSITION STEP IN PRODUCTION OF LOW MOLECULAR WEIGHT ORGANIC EL DEVICE

(75) Inventors: Norio Ishikawa, Saitama (JP); Yoshitaka Kinomura, Osaka (JP); Hideki Hijiya, Osaka (JP)

(73) Assignees: Kanto Kagaku Kabushiki Kaisha, Tokyo (JP); Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 11/185,290

(22) Filed: Jul. 20, 2005

(65) Prior Publication Data

US 2005/0252523 A1 Nov. 17, 2005

Related U.S. Application Data

(62) Division of application No. 11/002,871, filed on Dec. 2, 2004, now abandoned.

(30) Foreign Application Priority Data

Apr. 12, 2003 (JP) ..... 2003-406394

(51) Int. Cl.

| | |
|---|---|
| ***B08B 3/02*** | (2006.01) |
| ***B08B 3/12*** | (2006.01) |
| ***C11D 7/32*** | (2006.01) |
| ***C11D 7/50*** | (2006.01) |

(52) U.S. Cl. ..... 134/1.1; 134/34; 134/42; 510/163; 510/166; 510/175; 510/499; 510/500; 510/506

(58) Field of Classification Search ..... None
See application file for complete search history.

(56) References Cited

U.S. PATENT DOCUMENTS

2005/0115594 A1* 6/2005 Hosoda et al. ..... 134/61

FOREIGN PATENT DOCUMENTS

| | | | |
|---|---|---|---|
| JP | 2002-110345 | A | 4/2002 |
| JP | 2002-305079 | A | 10/2002 |
| JP | 2002-313564 | A | 10/2002 |
| JP | 2003-109759 | A | 4/2003 |
| JP | 2003-257664 | A | 9/2003 |

* cited by examiner

*Primary Examiner*—Gregory R. Del Cotto
(74) *Attorney, Agent, or Firm*—Wolf, Greenfield & Sacks, P.C.

(57) ABSTRACT

A cleaning solution for a mask used in a vacuum vapor deposition step in the production of a low molecular weight organic EL device is provided, the cleaning solution including one type or two or more types of aprotic polar solvent. There is also provided a cleaning method for a mask used in a vacuum vapor deposition step in the production of a low molecular weight organic EL device, wherein cleaning is carried out by immersion or jet flow using the cleaning solution.

5 Claims, 2 Drawing Sheets

CLEANING SOLUTION AND CLEANING METHOD FOR MASK USED IN VACUUM VAPOR DEPOSITION STEP IN PRODUCTION OF LOW MOLECULAR WEIGHT ORGANIC EL DEVICE

RELATED APPLICATIONS

This is a divisional of U.S. application Ser. No. 11/002,871, filed Dec. 2, 2004, now abandoned, the contents of which is incorporated by reference herein.

BACKGROUND OF THE INVENTION

1. Field of the Invention

The present invention relates to a cleaning solution and, in particular, to a cleaning solution and a cleaning method for removing an organic EL material adhering to a mask in a vacuum vapor deposition step in the production of a low molecular weight organic EL device.

2. Description of Related Art

Flat panel displays are attracting attention as display devices, and among them display devices equipped with a liquid crystal display device or an organic EL device are excellent. The liquid crystal display device has low power consumption but requires external lighting (back light) in order to obtain a bright screen, whereas the display device equipped with an organic EL device has the characteristics of not requiring a liquid crystal display device-type back light since the organic EL device is a self-emitting device, thus saving power, and also has characteristics such as high luminance and a wide viewing angle.

With regard to the organic EL device, there are two types, depending on the type of organic material, that is, a low molecular weight organic EL device and a polymer organic EL device, the two types employing different device production processes. The former employs film formation by a vapor deposition method, and the latter employs film formation by a spin coating method or an inkjet method after dissolution in a solvent.

With regard to the low molecular weight organic EL device, a layer-form structure is formed by vacuum vapor deposition using a mask, the layer-form structure comprising in turn on a glass substrate, for example, (1) an anode, (2) a hole-injecting layer, (3) a hole-transporting layer, (4) a light-emitting layer, (5) an electron-transporting layer, and (6) a cathode.

The mask generally used is a metal mask produced by etching, etc. of a metal such as SUS with a thickness of on the order of 0.1 mm, but as a mask that enables processing with higher precision, a mask produced by anisotropic etching of single crystal silicon having (100) or (110) orientation has been proposed (JP, A, 2002-110345, JP, A, 2002-305079, and JP, A, 2002-313564).

As one example of the structure of the low molecular weight organic EL device, there has been disclosed a multilayer structure comprising, for example, (1) indium tin oxide (ITO) as the anode, (2) a single layer of copper (II) phthalocyanine (CuPc) as the hole-injecting layer, (3) a single layer of N,N'-di(naphthalen-1-yl)-N,N'-diphenyl-benzidine (NPB) as the hole-transporting layer, (4) a layer of tris(8-quinolinolato) aluminum (Alq3) with 2% coumarin-6 added thereto as the light-emitting layer, (5) a single layer of Alq3 as the electron-transporting layer, and (6) a layer of an Mg/In alloy as the cathode (JP, A, 2003-109757).

In this example, CuPc is used as the hole-injecting layer, but a hole-injecting layer might not be provided in some cases. NPB is usually used as the hole-transporting layer.

The light-emitting layer is obtained by using a chelate metal complex or a fused polycyclic aromatic compound as a host and doping with various types of dopant. For blue light emission the fused polycyclic aromatic compound 2-tert-butyl-9,10-di(naphthalen-2-yl)anthracene (TBADN), etc. is used, and for red or green light emission the chelate metal complexes Alq3 and bis(benzoquinolinato) beryllium complex (BeBq2), etc. are used.

When TBADN is used as the light-emitting layer, an electron-transporting layer (e.g., Alq3) is generally used, and when the light-emitting layer is a chelate metal complex such as Alq3, the electron-transporting layer can sometimes be omitted (JP, A, 2003-257664).

For pattern formation of these layers, it is necessary to bring the mask close to the substrate and carry out vacuum vapor deposition, via the mask, of the cathode, the hole-injecting layer, the hole-transporting layer, the light-emitting layer, the electron-transporting layer, and the anode; in particular, it is difficult to produce a vapor deposition mask for fine patterning of an RGB layer because it is a high definition mask, and furthermore it is very expensive. However, in pattern formation of organic layers in the low molecular weight organic EL device, if vapor deposition is carried out several times using the same mask, since organic materials are deposited on and adhere to the mask, the high definition pattern of the mask cannot be transferred to the substrate accurately. Therefore, in order to realize a high definition mask pattern, once an expensive mask has been used a few times it has to be disposed of, and this makes mass production difficult from the viewpoint of production cost. In the organic EL field, which is in the development stage, reducing the cost by reusing the mask has not so far been attempted or investigated.

BRIEF SUMMARY OF THE INVENTION

Under the above-mentioned circumstances, the present inventors have carried out an investigation in order to develop an efficient cleaning solution for a mask with the new concept that, when producing a low molecular weight organic EL device, the mask is reused as many times as possible. That is, it is an object of the present invention to provide a cleaning solution and a cleaning method for efficiently removing various organic materials adhering to a mask in a vacuum vapor deposition step in the production of a low molecular weight organic EL device.

As a result of an intensive investigation by the present inventors in order to attain the above-mentioned object, it has been found that a cleaning solution comprising one type or two or more types of aprotic polar solvent exhibits excellent cleaning power for various organic materials adhering to a mask in a vacuum vapor deposition step in the production of a low molecular weight organic EL device, and as a result of a further investigation the present invention has been accomplished.

That is, the present invention relates to a cleaning solution for a mask used in a vacuum vapor deposition step in the production of a low molecular weight organic EL device, the cleaning solution comprising one type or two or more types of aprotic polar solvent.

Furthermore, the present invention relates to the cleaning solution wherein the low molecular weight organic EL device structure comprises N,N'-di(naphthalen-1-yl)-N,N'-diphenyl-benzidine, copper (II) phthalocyanine, and tris(8-quinolinolato) aluminum.

Moreover, the present invention relates to the cleaning solution wherein the aprotic polar solvent is N,N-dimethylformamide, N-methyl-2-pyrrolidinone, ethylene glycol dimethyl ether, diethylene glycol dimethyl ether, 1,4-dioxane, or cyclohexanone.

Furthermore, the present invention relates to the cleaning solution wherein the aprotic polar solvent is N-methyl-2-pyrrolidinone or cyclohexanone.

Moreover, the present invention relates to the cleaning solution wherein the cleaning solution comprises only one type of aprotic polar solvent.

Furthermore, the present invention relates to a cleaning method for a mask used in a vacuum vapor deposition step in the production of a low molecular weight organic EL device, wherein cleaning is carried out by immersion or jet flow using the cleaning solution.

Moreover, the present invention relates to the cleaning method wherein the method is combined with ultrasonic cleaning.

Furthermore, the present invention relates to the cleaning method wherein the cleaning is carried out at room temperature.

Moreover, the present invention relates to the cleaning method wherein after the mask is cleaned, it is rinsed with a hydrofluoroether.

The cleaning solution of the present invention enables one type or two or more types of low molecular weight organic EL devices adhering to the surface of various types of masks to be removed by a single type of cleaning solution, thereby allowing the mask to be reused. This shows a completely unpredictable practical effect in greatly reducing the cost when producing a mask or disposing of the mask in the present field where a high definition mask pattern is demanded. Moreover, since the cleaning solution of the present invention enables one type or two or more types of low molecular weight organic EL devices to be cleaned away with one type of cleaning solution, it is unnecessary to use different cleaning vessels for various types of cleaning solutions, resulting in the effect of making the cleaning process very simple. When the cleaning solution comprises only one type of aprotic organic solvent, the solvent obtained by distillation can be reused as it is for the cleaning solution of the present invention without adjusting the composition of the solvent.

Furthermore, since the cleaning solution of the present invention enables cleaning to be carried out at room temperature, even when the mask material is a metallic material such as, for example, SUS, metallic nickel (Ni), an Ni alloy with iron (Fe), etc. (e.g., an Fe—Ni alloy), the mask pattern does not expand or contract or deform, and when it is used repeatedly the pattern can be transferred accurately to a substrate.

Moreover, after a mask is cleaned using the cleaning solution of the present invention, it is rinsed using a hydrofluoroether, which has a high drying rate, and since the cleaning solution of the present invention has good solubility in the hydrofluoroether, it can easily be rinsed.

DETAILED DESCRIPTION OF THE INVENTION

Examples of the aprotic polar organic solvent used in the cleaning solution of the present invention include amide solvents such as N-methyl-2-pyrrolidinone and N,N-dimethylformamide, cyclic ketones such as cyclohexanone and cyclopentanone, and ether solvents such as 1,3-dioxane, diethylene glycol dimethyl ether, and ethylene glycol dimethyl ether, and among these N-methyl-2-pyrrolidinone and cyclohexanone are particularly preferable.

Moreover, the present aprotic polar organic solvent does not have to comprise just one type thereof; a cleaning solution comprising two or more types of these organic solvents in combination can be used, and this is preferable since the cleaning performance is excellent.

Furthermore, when the used cleaning solution is distilled and reused, even if the cleaning solution comprises a plurality of organic solvents, it is possible to reuse it by adjusting the composition of the liquid recovered by distillation.

Moreover, the cleaning solution of the present invention enables a mask used in a vacuum vapor deposition step in the production of a low molecular weight organic EL device to be cleaned at room temperature by a cleaning method involving immersion or jet flow. It is therefore unnecessary to employ high temperature during cleaning, and it is possible to prevent the mask from being deformed during cleaning. The room temperature referred to here is 10° C. to 40° C., preferably 20° C. to 30° C., and more preferably about 25° C.

Furthermore, the use of ultrasonic cleaning in combination with the cleaning solution of the present invention during mask cleaning can improve the dissolution performance and reduce the cleaning time.

Moreover, the cleaning solution of the present invention may employ rinsing using various types of rinsing liquid having a high drying rate and, for example, hydrofluoroethers, which are known as rinsing liquids having a high drying rate, are particularly preferable as the rinsing liquid.

Figure 1:
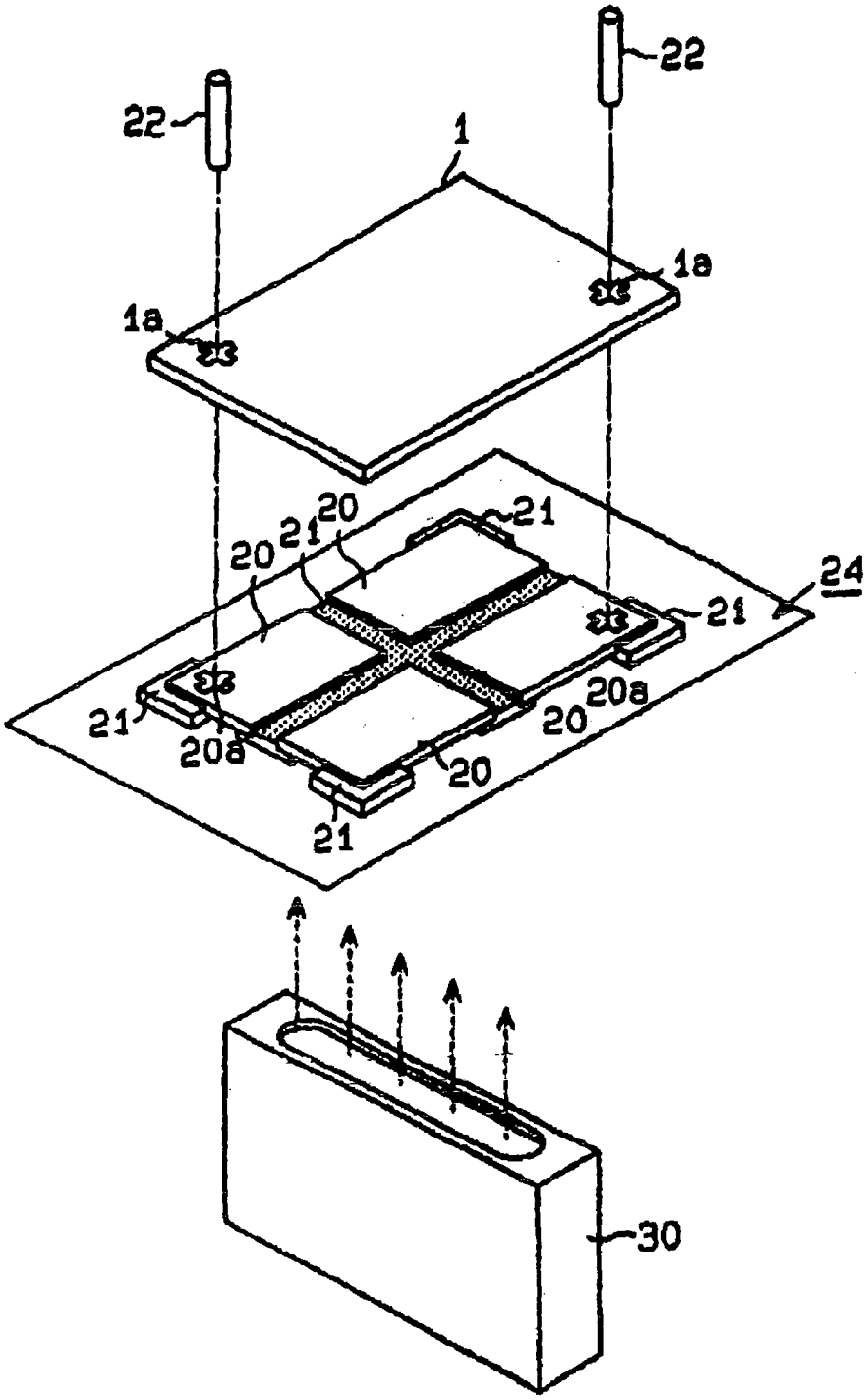
FIG. 1 is a perspective view showing an embodiment of the alignment of a mask and a glass substrate within a vacuum chamber.

A process for producing an EL display device is explained below. A glass substrate having a TFT and a transparent electrode and, moreover, a hole-transporting layer formed thereon is inserted into a vacuum chamber with the glass substrate facing vertically downward. A mask 20 having an opening that matches the shape of the light-emitting layer in an embodiment shown in FIG. 1 is placed within the chamber. More particularly, this mask 20 is fixed by a mask frame 21 disposed on a retaining stage 24.

In addition, 1*a* and 20*a* described in FIG. 1 indicate an alignment mark, and 22 described in FIG. 1 indicates a CCD camera.

This step is carried out for each of the primary colors R, G and B of a color display device. That is, a glass substrate 1 having thereon a hole-transporting layer is inserted, in turn, into separate vacuum chambers for forming a light-emitting layer corresponding to each of the primary colors R, G and B. Each vacuum chamber is equipped with, as the mask 20, a mask having an opening only in an area corresponding to the transparent electrode (anode) used for light emission of a given primary color. That is, each vacuum chamber is equipped with a mask corresponding to one of R, G and B. It is possible in this way to form, at a predetermined position, a light-emitting layer for a given primary color in the corresponding chamber.

In FIG. 1, a material for the light-emitting layer is heated and vaporized from a vapor deposition source 30 placed beneath the retaining stage 24, thus vapor depositing the material on the surface of the glass substrate 1 via the mask opening.

Figure 2:
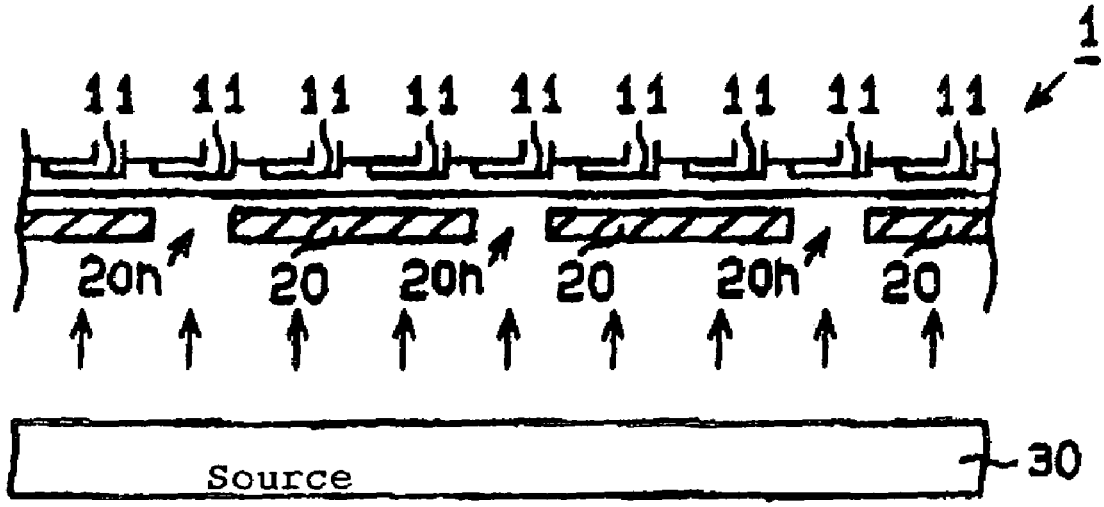
FIG. 2 is a side view schematically showing an embodiment of the formation of an EL device by vapor deposition.

An embodiment of formation of the light-emitting layer via the mask 20 is shown schematically in FIG. 2. As shown in FIG. 2, an area of the transparent electrode (anode) other than the region forming the transparent electrode corresponding to the given primary color is covered with the mask 20 in the corresponding chamber. The EL device (organic EL device) corresponding to the given primary color is heated within the source 30, vaporized, and vapor deposited on the glass substrate 1 (more accurately, on the hole-transporting layer) via an opening 20*h* of the mask 20.

Examples of the mask material include SUS, metallic Ni, an Ni alloy with Fe, etc. (e.g., an Fe—Ni alloy), or a semiconductor such as silicon.

The present invention is explained in detail below with reference to Examples of the present invention shown below together with Comparative Examples, but the present invention is not limited by these examples. There is no conventionally known cleaning solution in the present technical field; organic solvents used in Reference Examples are also novel solvents for cleaning an organic EL device, but they are solvents generally used for removing an organic compound in other fields, and were used for reference experiments.

EXAMPLES

Low Molecular Weight Organic EL Device Cleaning Test 1: Cleaning Performance, Rinsing Performance The five types of low molecular weight organic EL devices shown in Table 1 were investigated for cleaning performance (removal time) and rinsing performance. With regard to the cleaning performance, metal pieces having the materials vapor deposited thereon were immersed in a cleaning solution at room temperature (25° C.), and with regard to the rinsing performance, a 'two vessel treatment' was employed in which Sumitomo 3M Novec HFE7100 (hydrofluoroether) was used as a rinsing liquid after cleaning, and immersion was carried out at room temperature (25° C.) in two vessels filled with the rinsing liquid for 1 minute each. The results are given in Table 2.

Moreover, with regard to the cleaning performance, use of the cleaning method involving immersion in combination with ultrasonic waves was also investigated. The results are given in Table 3 together with the results of Comparative Examples.

TABLE 1

Table 1: Materials subjected to cleaning

| Symbol | Low molecular weight organic EL device |
|---|---|
| A | NPB |
| B | CuPc |
| C | TBADN |
| D | Alq3 |
| E | Alq3 + TBADN |

TABLE 2

Table 2: Cleaning performance, Rinsing perfomance

| | Cleaning solution | Cleaning performance A | B | C | D | E | Rinsing performance |
|---|---|---|---|---|---|---|---|
| Comparative Example 1 | 3-Methyl-3-methoxy-1-butanol | X | X | ○ | ○ | ○ | ○ |
| Comparative Example 2 | γ-Butyrolactone | ◉ | X | ◉ | ◉ | ◉ | ○ |
| Comparative Example 3 | Lactic acid | X | X | ◉ | ◉ | ◉ | ○ |
| Comparative Example 4 | Diethylene glycol monomethyl ether | X | X | ◉ | ◉ | ◉ | ○ |
| Example 1 | N-Methyl-2-pyrrolidinone | ◉ | ◉ | ◉ | ◉ | ◉ | ○ |
| Example 2 | Cyclohexanone | ◉ | ◉ | ◉ | ◉ | ◉ | ○ |
| Example 3 | N,N-Dimethylformamide | ◉ | ○ | ◉ | ◉ | ◉ | ○ |
| Example 4 | Ethylene glycol dimethyl ether | ◉ | ○ | ◉ | ◉ | ○ | ○ |
| Example 5 | Diethylene glycol dimethyl ether | ◉ | ○ | ◉ | ◉ | ○ | ○ |
| Example 6 | 1,4-Dioxane | ○ | ○ | ◉ | ○ | ○ | ○ |

Cleaning performance
◉: Removable within 1 minute
○: Removable in 3 minutes
X: Could not be removed
Rinsing performance
○: Good
X: Inadequate

TABLE 3

Table 3: Cleaning performance with combined use of ultrasonic waves

| | Cleaning solution | Cleaning performance A | B | C | D | E |
|---|---|---|---|---|---|---|
| Comparative Example 1 | 3-Methyl-3-methoxy-1-butanol | X | X | ◉ | ◉ | ◉ |
| Comparative Example 4 | Diethylene glycol monomethyl ether | X | X | ◉ | ◉ | ◉ |
| Example 1 | N-Methyl-2-pyrrolidinone | ◉ | ◉ | ◉ | ◉ | ◉ |
| Example 2 | Cyclohexanone | ◉ | ◉ | ◉ | ◉ | ◉ |
| Example 5 | Diethylene glycol dimethyl ether | ◉ | ◉ | ◉ | ◉ | ◉ |

As shown in Tables 2 and 3, the solvents used in the Comparative Examples were not able to remove all of the low molecular weight organic EL devices A to E with a single type of solvent at room temperature (25° C.) either by the cleaning method involving immersion or the cleaning method involving the combined use of ultrasonic waves.

On the other hand, the solvents of the Examples were able to remove all of the low molecular weight organic EL devices A to E with a single type of organic solvent at room temperature (25° C.) by the cleaning method involving immersion.

Furthermore, the cleaning performance at room temperature (25° C.) was further improved by using ultrasonic waves in combination with the cleaning method involving immersion.

What is claimed is:

1. A cleaning method for a mask used in a vacuum vapor deposition step in the production of a low molecular weight organic electro luminescence (EL) device, comprising cleaning the mask, wherein said cleaning is carried out by immersion or jet flow, with a solution consisting of N-methyl-2-pyrrolidinone and one or more aprotic polar solvents selected from the group consisting of N,N-dimethylformamide, ethylene glycol dimethyl ether, diethylene glycol dimethyl ether, 1,4-dioxane, and cyclohexanone, or consisting of one or more aprotic polar solvents selected from the group consisting of N,N-dimethylformamide, ethylene glycol dimethyl ether, diethylene glycol dimethyl ether, 1,4-dioxane, and cyclohexanone.

2. The cleaning method according to claim 1, wherein the low molecular weight organic electro luminescence (EL) device comprises N,N'-di(naphthalen-1-yl)-N,N'-diphenylbenzidine, copper (II) phthalocyanine, and tris(8-quinolinolato)aluminum.

3. The cleaning method according to claim 1, wherein the method is combined with ultrasonic cleaning.

4. The cleaning method according to claim 1, wherein the cleaning is carried out at room temperature.

5. The cleaning method according to claim 1, wherein after the mask is cleaned, it is rinsed with a hydrofluoroether.

* * * * *

UNITED STATES PATENT AND TRADEMARK OFFICE

CERTIFICATE OF CORRECTION

PATENT NO. : 7,073,518 B2
APPLICATION NO. : 11/185290
DATED : July 11, 2006
INVENTOR(S) : Norio Ishikawa et al.

It is certified that error appears in the above-identified patent and that said Letters Patent is hereby corrected as shown below:

On Title Page, Item (30) col. 1, please correct the date of the Japan priority application by deleting "Apr. 12, 2003" and replacing it with the correct priority date -- Dec. 4, 2003 --.

Signed and Sealed this

Twenty-first Day of November, 2006

JON W. DUDAS
*Director of the United States Patent and Trademark Office*